United States Patent [19]

Elliott

[11] 4,100,977

[45] Jul. 18, 1978

[54] DROP HAMMERS

[75] Inventor: Roger Michael Elliott, Ipswich, England

[73] Assignee: BSP International Foundations Limited, Ipswich, England

[21] Appl. No.: 797,232

[22] Filed: May 16, 1977

[30] Foreign Application Priority Data

May 21, 1976 [GB] United Kingdom ..... 21195/76

[51] Int. Cl.[2] ..... B25D 9/00

[52] U.S. Cl. ..... 173/134; 173/127; 173/DIG. 4; 91/328

[58] Field of Search ..... 90/304, 311, 328; 173/90, 126, 127, 134, DIG. 4

[56] References Cited

U.S. PATENT DOCUMENTS

| | | | |
|---|---|---|---|
| 2,803,110 | 8/1957 | Chittenden | 91/304 X |
| 3,468,222 | 9/1969 | Cordes et al. | 173/134 X |
| 3,469,400 | 9/1969 | Oikawa et al. | 173/127 X |
| 3,669,198 | 6/1972 | Elliott | 173/127 |

FOREIGN PATENT DOCUMENTS

| | | | |
|---|---|---|---|
| 1,263,629 | 3/1968 | Fed. Rep. of Germany | 173/134 |
| 983,403 | 2/1965 | United Kingdom | 173/126 |
| 464,687 | 7/1975 | U.S.S.R. | 173/90 |
| 489,847 | 2/1976 | U.S.S.R. | 173/134 |

*Primary Examiner*—Lawrence J. Staab
*Attorney, Agent, or Firm*—Larson, Taylor and Hinds

[57] ABSTRACT

A drop hammer has a hydraulic cylinder and piston assembly with a hammer weight attached to the piston and a sleeve valve at the lower end of the cylinder coaxial with the cylinder. An outer casing surrounds the cylinder, forming an annular passage from the valve to the upper end of the cylinder. Through servo control means that may be automatically operated by the hammer movement, the valve alternately admits pressure to the cylinder space below the piston to raise the weight, and opens said cylinder space to the annular passage to put both ends of the cylinder in communication and allow the hammer weight to fall.

4 Claims, 6 Drawing Figures

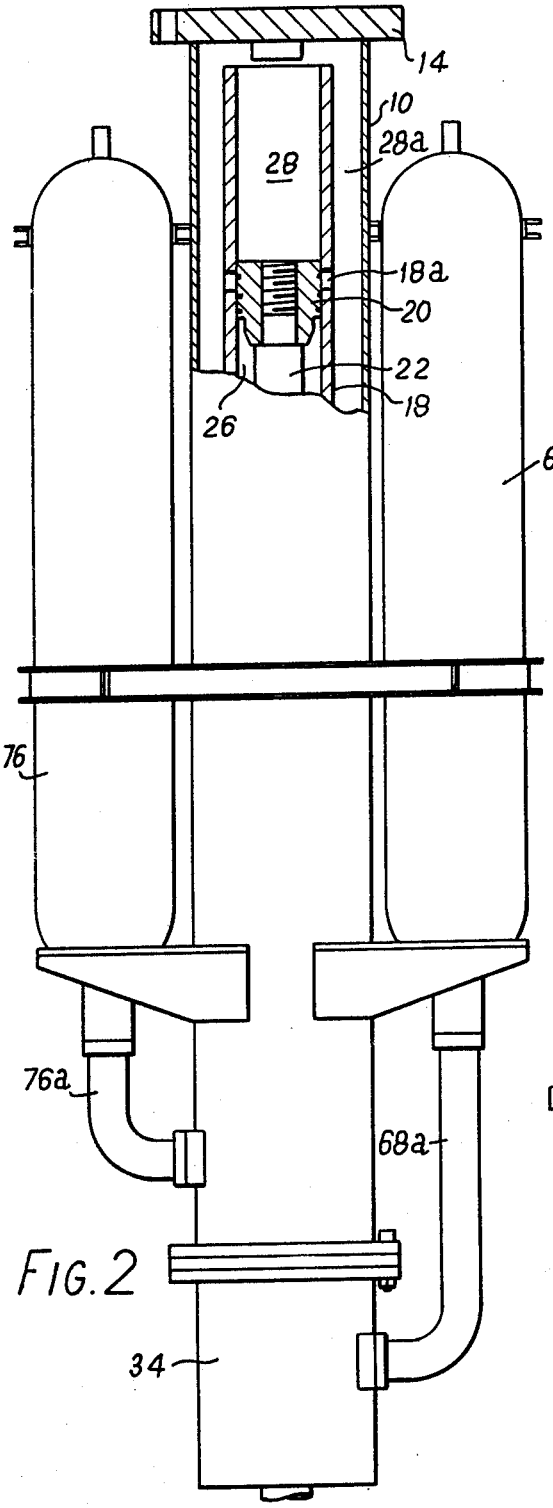
FIG. 2
FIG. 4
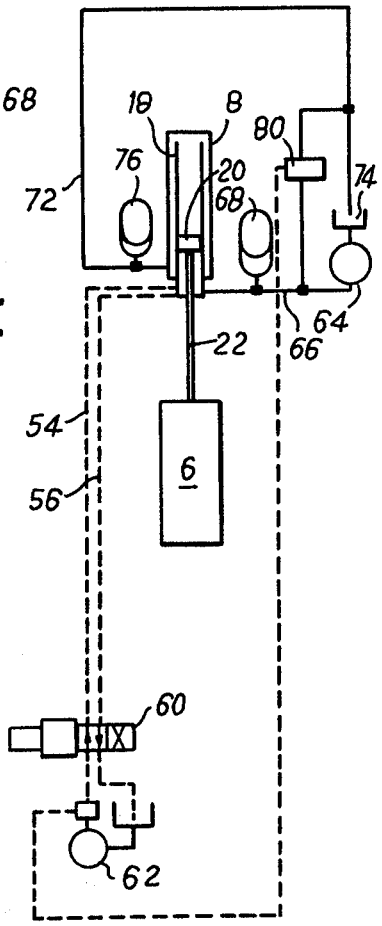

DROP HAMMERS

BACKGROUND OF THE INVENTION

This invention relates to drop hammers in which a hammer weight is operated by a hydraulic pressure mechanism. Such hammers are known using a cylinder and piston combination in the hydraulic pressure mechanism, it usually being arranged that hydraulic fluid is admitted to the cylinder at one side of the piston to raise the hammer weight, and the subsequent descent of the weight is used as the working stroke to produce the hammer blow, e.g. to drive a foundation pile.

In such mechanisms, the maximum working rate is usually determined by the rate at which the hydraulic fluid can be fed to and released from the cylinder. The rise of the piston is obviously dependent upon the maximum rate at which pressure fluid can be fed to the cylinder but, in addition, during the fall of the hammer, when the cylinder space previously receiving pressure fluid is contracting, the maximum rate of flow from it may be limited by throttling effects causing a back pressure that slows the descent of the hammer weight, and the performance of the hammer will be correspondingly affected by this also.

UK Patent specification No. 1,261,220 describes a way of avoiding this difficulty by arranging that fluid is transferred between opposite sides of the piston at appropriate stages in a working cycle. In one arrangement disclosed, the piston itself contains the transfer valve, while in another arrangement a transfer valve is disposed externally of the cylinder, in a by-pass between inlet and outlet conduits connected to the cylinder. The first of these arrangements is particularly advantageous, since the fluid travels the shortest possible path between the spaces on opposite sides of the piston. The externally disposed valve arrangement has the advantage of being more easily accessible for servicing but is less efficient in operation.

It is found that although the form of transfer valve shown in this earlier patent can give good results, even the arrangement in which the transfer valve is contained in the piston can only be usefully employed up to a maximum size of hammer. If the scale of the design is further increased, inertia effects become more prominent and eventually interfere with the correct operation of the valve and also reduce undesirably its reliability. The alternative arrangement described, with the valves in a by-pass between inlet and outlet conduits to the hydraulic cylinder, is not subjected to these particular disadvantages but it is relatively inefficient and is equally unsatisfactory for larger hammers. The problem therefore remains of producing a large hydraulically driven drop hammer, e.g. with a hammer weight of 20 tonnes or more, that can be operated at a relatively high striking rate.

SUMMARY OF THE INVENTION

According to the present invention, in a drop hammer having a hydraulic ram for displacing a hammer weight, said ram comprising an upwardly extending cylinder piston assembly and valve-controlled conduit means interconnecting the internal chambers of the cylinder at opposite sides of the piston, there is provided a controlling valve disposed at one end of the cylinder, coaxially with the cylinder and piston assembly, and externally operable control means are provided for actuating the valve to connect and disconnect said chambers to reciprocate the hammer weight.

In a preferred form of the invention, the conduit means comprise an annular space between the cylinder and an outer casing surrounding the cylinder and in permanent communication with the chamber above the piston so as to form a continuation of that upper cylinder chamber. Such an arrangement can provide a large cross-section passage for the transfer of fluid between the two ends of the cylinder, supplementing the effect obtained from the placing of the valve means immediately adjacent the lower end space of the cylinder, so that when hydraulic fluid is being transferred between the cylinder chambers throttling of the flow is minimised.

It is desirable also to prevent throttling of the inflow of hydraulic fluid from the pressure source to the ram, and to build up a store of pressure fluid during the fall of the hammer a high pressure accumulator can be located immediately adjacent the inlet to the control valve. In a further preferred feature, a low-pressure accumulator is mounted adjacent the piston and cylinder assembly and connected to the fluid outlet from the ram, conveniently communicating directly with the cylinder outer casing space, so as to limit the pressure increase produced in the fluid exhausted from the ram by the resistance to flow in the return line to the fluid reservoir.

The control valve is preferably in the form of a sleeve valve with respective porting for placing the upper and lower cylinder chambers in communication and for admitting pressure fluid to the lower chamber. The sleeve valve is conveniently disposed between inner and outer annular spaces and is provided by pilot valve control means for external operation from a position remote from the hammer.

BRIEF DESCRIPTION OF THE DRAWINGS

The invention will be more particularly described by way of example with reference to the accompanying schematic drawings, wherein:

FIG. 2 is a side view of the hydraulic ram of the hammer in FIG. 1, with its fluid accumulators, FIG. 4 is a diagram of the hydraulic circuit for the ram.

DESCRIPTION OF THE PREFERRED EMBODIMENT

Figure 1:
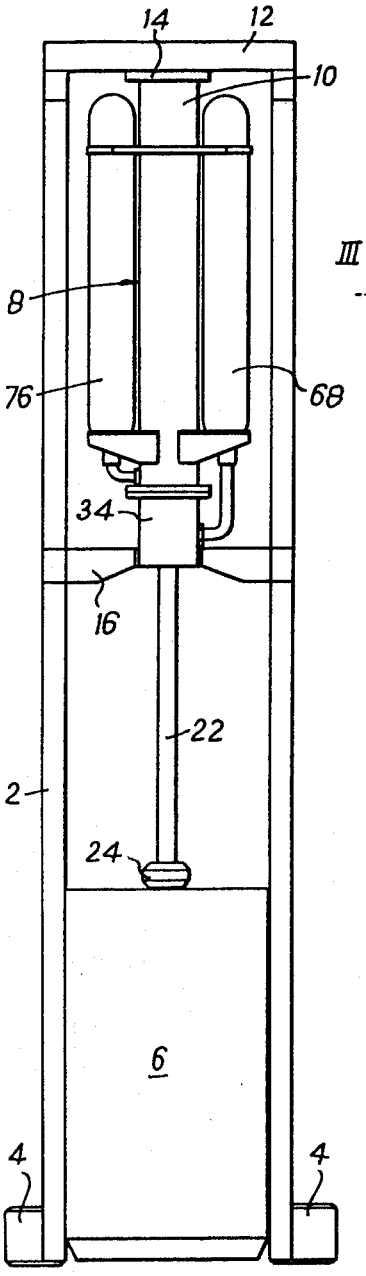
FIG. 1 is a side view of a drop hammer according to the invention.

The hammer illustrated is intended for pile driving operations and comprises a main frame 2 having at its lower end support pads 4, preferably incorporating springs, for mounting the hammer on a pile cap (not shown). A hammer weight 6 slidably guided by the frame is reciprocated by a hydraulic ram 8 mounted in the frame. The ram comprises an outer casing 10 bolted to the upper end 12 of the frame by its top flange 14 and laterally located by intermediate plate 16 of the frame. A hydraulic cylinder 18 is disposed in the casing and a piston 20 in the cylinder has a depending piston rod 22 from which the weight 6 is suspended, through a preferably resilient coupling 24.

The region within the cylinder below the piston forms a first, lower chamber 26 that is normally sealed from a second chamber 28 comprising the cylinder volume above the piston. This upper chamber is in permanent and free communication with an outer annular space 28*a* between the cylinder and the outer casing 10. At its lower end the ram has valve means for interconnecting the chambers 26, 28 comprising a sleeve valve 30 coaxial with the piston and cylinder and axially displaceable in bore 32 of a housing formed by an end block 34 of the casing, in which a series of axial bores 36 provide free communication between the outer space 28*a* and an annular chamber 38 opening onto the valve, and the annular space 39 between the valve 30 and the piston rod 22 opens directly into the chamber 26.

Figure 2A:
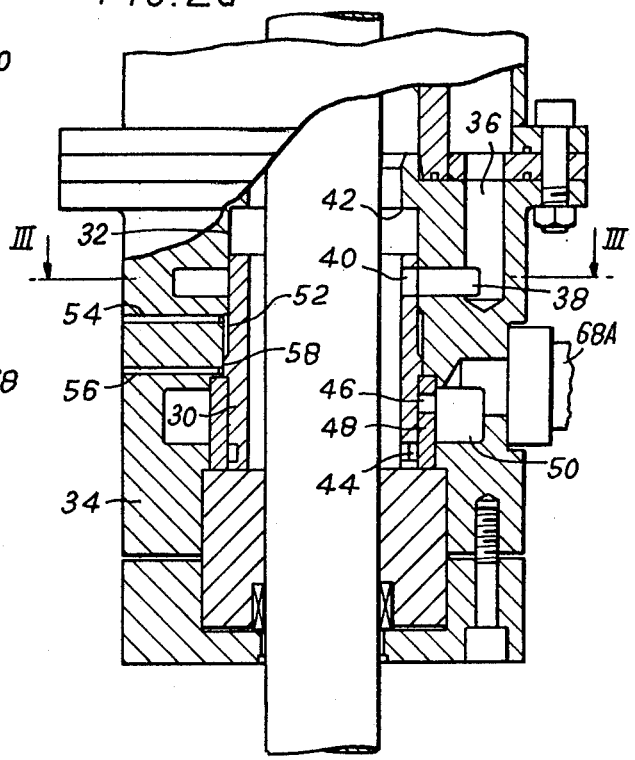
FIG. 2*a* is a detail view, in section, of the lower part of FIG. 2.

In the lowermost position of the sleeve valve 30 shown in FIG. 2, an upper ring of ports 40 in the valve are registered with the chamber 38 so that the upper and lower cylinder chambers 26, 28 are in communication through the valve and the annular space 28*a*. The valve is displaceable from there to an upper end position, in which it abuts against shoulder 42 at the end of the bore 32, when a lower series of ports 44 in the valve are registered with a series of ports 46 in a sealing ring 48 to communicate with an inlet chamber 50 connected to pressure fluid supply line 66 (FIG. 4) through a coupling union (not shown). In this position the chambers 26, 28 are isolated from each other and hydraulic fluid is admitted to the chamber 26 to raise the piston and the hammer weight with it. Should the piston rise above ports 18*a* in the cylinder wall, connection between the two chambers 26, 28 is re-established through the annular space 28*a* independently of the position of the sleeve valve 30.

Between the bore 32 of the end block housing 34 and the sleeve valve there is formed a pilot pressure chamber 52 having alternative supply lines 54, 56 respectively, to upper and lower ends of the chamber 52 that are sealed from each other by land 58 of the sleeve valve. A pilot valve 60 (FIG. 4) communicating with the ports is controlled manually and/or by automatically operated electrical switching means, which may comprise trip switches operated with the movement of the hammer and/or impact switches operable by the impact of the hammer on the pile cap, said switches acting on the valve 60 through an electronic control circuit.

As one possible arrangement, the pilot valve 60 is a solenoid-operated valve with a return spring biasing it to the illustrated position, in which pressure fluid from an auxiliary pump 62 is directed through line 54 to urge the sleeve valve 30 to the lower position shown in FIG. 2. Since the upper and lower cylinder chambers are then in communication, the weight is able to fall to impact the pile cap, the piston moving to its bottom position in the cylinder. To change the pilot valve over, the valve solenoid is actuated by an impact switch on the hammer frame that is triggered by the impact of the falling hammer weight. Pressure fluid is then admitted through the line 56 to switch the sleeve valve and the main pressure fluid supply from a pump 64 flows through the line 66 to the lower cylinder chamber.

The solenoid is held in by an adjustable delay timer that thereby controls the height to which the weight is raised and so determines the impact force. The flow from the pump 64 is augmented by a flow from a high-pressure accumulator 68 mounted on the hammer frame that has received the output of the pump 64 during the downstroke of the ram. It is thus possible to direct a very large flow of fluid at pressure into the lower cylinder chamber through the large-bore conduit 68*a* and the large cross-section passages provided by the immediately adjacent sleeve valve, with a minimal throttling effect, even if the supply pump 64 is some distance from the ram.

Also during the upstroke, exhaust fluid will be expelled from the upper cylinder chamber through exhaust line 72 to reservoir 74. To limit the pressure rise in the line 72 that would otherwise increase resistance to the lifting of the hammer weight, a low-pressure accumulator 76 is also mounted on the hammer frame and is connected to the annular space 28*a* through large-bore conduit 76*a*, thereby being able to absorb the surge of exhaust fluid. In addition, the accumulator 76 functions during the downstroke to provide a ready return flow of fluid into the ram when the volume of the ram fluid spaces is expanding because of the extension of the ram piston rod, so avoiding vacuum conditions that might lead to cavitation in the fluid and also cause some retardation of the falling weight. The provision of the accumulators thus allows the hydraulic fluid supply system to be located at any convenient position and some distance from the hammer itself.

At start-up it can be arranged that when power is made to the circuit of the impact switch and solenoid, an actuating pulse is received by the solenoid to lift the weight from rest. Additionally or alternatively there can be a manual override.

FIG. 4 also shows a valve 80 in the main hydraulic circuit in a line bypassing the hydraulic cylinder. This is a combined relief and unloader valve and for the latter purpose it may comprise an actuating solenoid with spring return. The unloading function will be under the control of the operator, and the valve may be arranged so that the hydraulic cylinder is bypassed either when the solenoid is actuated, or alternatively it may be preferred that the actuated solenoid closes the valve (but does not interfere with its overpressure relief function) and when the solenoid is de-energised the bias spring opens the valve.

Figure 3:
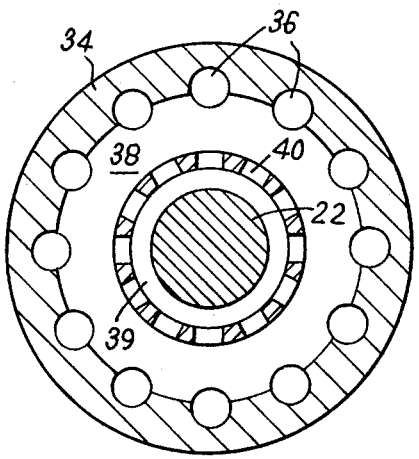
FIG. 3 is a detail cross-sectional view on the plane III—III in FIG. 2*a*.
Figure 5:
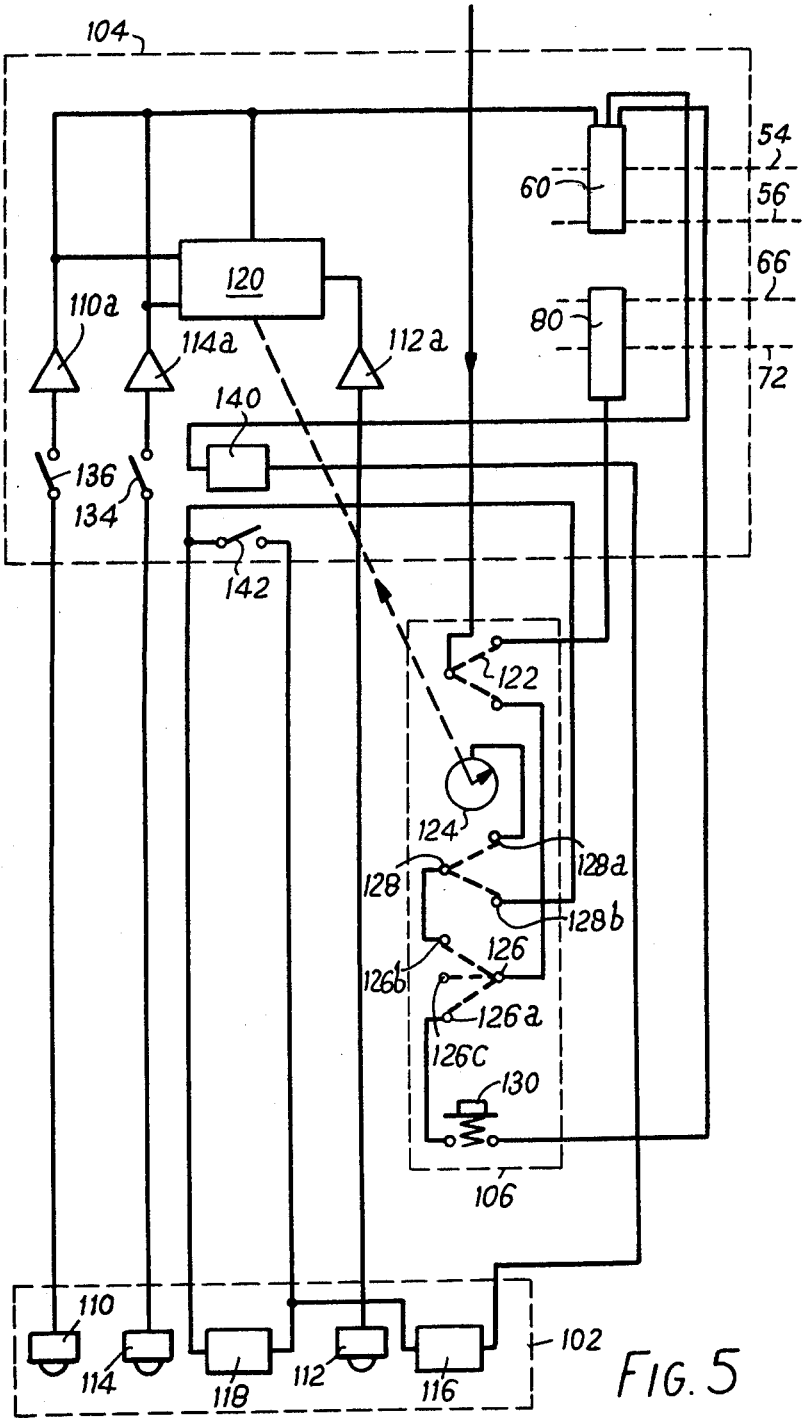
FIG. 5 illustrates an electrical control system that can be employed in the drop hammer of the preceding figures.

FIG. 5 shows schematically an electrical control arrangement for the hammer of FIGS. 1 to 3 using a number of different limit switch combinations. The electrical circuits control the pilot valve 60 and the relief/unloader valve 80 of the solenoid-operated spring-return form described with reference to FIG. 4. In FIG. 5, enclosure 102 represents the hammer frame and indicating the limit switches provided there for controlling the operation of the hammer. These include a ferrite rod inductive switch 110 arranged as an impact detector, respective trip-operated switches 112, 114 for upper and lower limits of the hammer movement and of the same ferrite rod inductive type as the switch 110, and electromechanical upper and lower limit switches 116, 118 in the form of bistables, set at positions on the hammer frame corresponding to those of the switches 112, 114. A delay timer 120 operates as an adjustable upper limit switch, but this can be mounted remote from the hammer frame, for example in a control console represented by the enclosure 104.

FIG. 5 also indicates at 106 a control pendant that is connected by a flexible cable (not shown) to the console to allow the hammer operator freedom of movement while the hammer is at work so that he can more readily control the pile-driving process. On the control pendant are an on-off dump switch 122, a control potentiometer 124 for the timer 120, a three-position selector switch 126 with a "manual" contact 126*a* an "automatic operation" contact 126*b* and an "off" contact 126*c*, a changeover switch 128 operated when the switch 126 is in its "automatic operation" position to select an adjustable stroke (contact 128*a*) or a maximum stroke (contact 128*b*) for the reciprocation of the hammer ram, and a manual operation push-bottom switch 130.

In its "on" position the dump switch connects the power supply to the solenoid of the relief/unloader valve 80 so that the hammer weight cannot be raised. (It is alternatively possible, as already mentioned, to have an arrangement in which the valve 80 is opened by its spring bias with the solenoid de-energised). In either case, the switch 122 is arranged so that when the unloader valve is closed, the selector switch 126 is connected to the power supply and is thus brought into operation. If it is in the "manual" position 126*a*, the hammer is operated by means of the push button switch 130 that is spring-biased to a normally open state. If the switch 126 is in its "automatic operation" position 126*b*, the operator can select, by means of the switch 128, operation of the ram at its maximum stroke (contact 128*b* made) or at a variable stroke (contact 128*a* made), the length of stroke in the latter case being determined by the setting of the potentiometer 124 which can be adjusted continuously during the operation of the hammer.

Selecting the automatic operation mode of the hammer, with adjustable stroke renders the inductive switches 110, 112 and 114 active. With the hammer weight initially at its bottom position, the bottom limit switch 114 will be in a state that energises the operating solenoid of the pilot control valve 60 and pressure fluid is admitted to the underside of the ram piston to raise the hammer weight. The delay timer 120 may, dependent upon the setting of the potentiometer 124, determine the upper limit of the hammer weight movement but a maximum limit is in any event provided by the upper limit switch 112 on the hammer frame. The ports 18*a* provide a further override that switches the direction of the resultant hydraulic force on the piston if the piston rises past them.

When the weight has risen sufficiently to operate the trip of the switch 112, the resulting output through amplifier 112*a* causes the timer to discharge and so to de-energise the pilot valve solenoid. Thereupon the pilot valve is switched to lift the ram sleeve valve 30, cutting the ram off from the pressure supply and bringing the cylinder chambers 26, 28 into communication. The hammer weight is allowed to fall, therefore, fluid flowing into the upper chamber partly by direct transfer from the lower chamber and partly from the low-pressure accumulator on the hammer frame.

As the hammer weight approaches the anvil or other impact surface, it operates the trip of the bottom limit switch 114, and if switch 134 is closed this will re-energise the pilot valve solenoid through amplifier 114*a*. The pressure supply is then again switched to the underside of the ram piston and the delay timer 120 is set in operation. Alternatively, switch 136 in circuit with the impact detector switch 110 may be closed instead of the switch 134, so that the switching of the valve solenoid and the actuation of the timer via amplifier 110*a* begins at the instant of impact of the hammer weight. Both switches can be closed so that one acts as a back-up for the other but there can alternatively be a changeover switch allowing one or other of the inductive switches 110, 114 to be put in circuit, in which case a single amplifier can replace respective amplifiers through which the bottom limit inductive switch signals operate.

The dial-form potentiometer 124 on the control pendant can be adjusted while the hammer is operating and if it is at a setting that causes the timer to time out before the upper limit switch trip is reached the stroke of the hammer will be correspondingly reduced.

While the adjustable control allows the hammer to be operated at maximum stroke, there can be advantages in providing a separate circuit using more robust electromechanical switches for operation in this mode, and by moving the changeover switch to its alternative position 128*b* the trip-operated upper and lower limit switches 116 and 118 are rendered active.

With the hammer at the bottom of its stroke, both the switches 116, 118 will be closed and the pilot valve solenoid will be energised to allow the hammer weight to be raised, the circuit to that solenoid including a relay 140 that will also be energised to close its switch 142. In the initial part of the rising movement the lower limit switch 118 is opened as its trip is displaced by the hammer weight, but with no effect because its circuit is bypassed by the closed contact 142. When the upper limit switch 116 is also opened by operation of its trip the circuit to both the pilot valve solenoid and the relay 140 is broken and the sleeve valve 30 is switched to allow the hammer weight to fall. The upper limit switch 116 is closed again almost immediately as the descent begins but since the switch 140 has already opened, this now has no effect on the operating solenoid circuit. Only when the lower limit switch 118 is tripped to close again and bypass the switch 140 is the circuit made via both switches 116, 118 to re-energise the pilot valve solenoid and the relay 140, and the cycle recommences.

Using the manual push-button control, the stroke of the hammer weight is determined simply by the length of time for which the push-button switch 130 is depressed. The ports 18*a* limit the point at which the fluid pressure will act to drive the weight upwards, but it may be also desired for reasons of safety to provide also an upper limit switch. The circuit of the push button switch 130 can for example be connected to the circuit of the limit switches 116, 118, as by connecting the switch 130 to the pilot valve solenoid via the control 128*b*, so that the opening of the limit switch 116 de-energises the solenoid.

What is claimed is:

1. A drop hammer comprising a hammer weight, a hydraulic ram connected to said weight for displacing said weight, said ram comprising an upwardly extending cylinder and a piston slidable in said cylinder, respective internal chambers of the cylinder being formed thereby above and below the piston, an outer casing surrounding the cylinder, an outer annular space being formed thereby between the cylinder and the outer casing, said space being in permanent communication with an upper end of the cylinder chamber above the piston, a hydraulic pressure source for supplying pressure fluid to said chambers, a control valve for said fluid and for interconnecting said internal chambers of the cylinder and being disposed at the lower end of the cylinder and co-axially with the cylinder and piston, said outer annular space forming a continuation of said cylinder chamber above the piston leading to the control valve, control means comprising a control device externally of said valve and connected thereto for actuating the valve to control the supply of pressure fluid and to connect and disconnect the internal chambers of the cylinder for reciprocation of the hammer weight.

2. A drop hammer according to claim 1 having a return flow line from the ram for fluid exhausted from the ram and a low pressure accumulator for said return flow for damping pressure rises thereof being mounted adjacent the ram cylinder and being connected to the outer annular space.

3. A drop hammer according to claim 1 wherein the control valve is a sleeve valve, a valve housing slidably supporting said valve, and respective porting in said valve and housing for placing the upper and lower cylinder chambers in communication and for admitting pressure fluid to the lower chamber by sliding displacement of the valve relative to the housing.

4. A drop hammer according to claim 1 wherein the control valve is in the form of a sleeve valve, inner and outer annular spaces surrounding the sleeve valve and porting in the sleeve valve for establishing communication between said spaces, pilot valve control means for acting on said sleeve valve to displace it to and from a position in which said spaces are put in communication with each other through the valve, said spaces opening into or communicating with the upper and lower chambers of the cylinder.

* * * * *